US008500401B1

(12) United States Patent
Liang

(10) Patent No.: US 8,500,401 B1
(45) Date of Patent: Aug. 6, 2013

(54) TURBINE BLADE WITH COUNTER FLOWING NEAR WALL COOLING CHANNELS

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 0 days.

(21) Appl. No.: 13/539,720

(22) Filed: Jul. 2, 2012

(51) Int. Cl.
*F01D 5/08* (2006.01)
*F01D 5/18* (2006.01)

(52) U.S. Cl.
USPC ..... 416/1; 416/97 R; 416/97 A; 416/96 R; 416/96 A; 415/1; 415/115; 415/116

(58) Field of Classification Search
USPC ..... 416/1, 96 R, 97 R, 96 A, 97 A; 415/1, 415/115, 116
See application file for complete search history.

(56) References Cited

U.S. PATENT DOCUMENTS

| | | | | |
|---|---|---|---|---|
| 6,264,428 | B1 * | 7/2001 | Dailey et al. | 416/97 R |
| 6,705,836 | B2 * | 3/2004 | Bourriaud et al. | 416/97 R |
| 6,769,866 | B1 * | 8/2004 | Kannefass et al. | 415/115 |
| 7,303,376 | B2 * | 12/2007 | Liang | 416/96 R |
| 7,527,475 | B1 * | 5/2009 | Liang | 416/97 R |
| 7,568,887 | B1 * | 8/2009 | Liang | 416/97 R |
| 7,641,445 | B1 * | 1/2010 | Liang | 416/97 R |
| 7,819,629 | B2 * | 10/2010 | Liang | 416/97 R |
| 8,047,790 | B1 * | 11/2011 | Liang | 416/97 R |
| 8,360,726 | B1 * | 1/2013 | Liang | 416/97 R |

* cited by examiner

*Primary Examiner* — Igor Kershteyn
(74) *Attorney, Agent, or Firm* — John Ryznic

(57) ABSTRACT

A turbine rotor blade with counter flowing near wall cooling channels that includes an outer spanwise flowing near wall cooling channel and an inner chordwise flowing near wall cooling channel connected in series and with an arrangement of pedestals to produce turbulent flow. Cooling air form the spanwise flow channels flows through a blade tip floor cooling channel and then into a collection cavity, and then through impingement cooling holes in the leading edge region and into the chordwise channels before discharging out exit holes on both sides of the blade. An arrangement of pedestals forms 90 degree flow paths through the near wall cooling channels.

9 Claims, 7 Drawing Sheets

TURBINE BLADE WITH COUNTER FLOWING NEAR WALL COOLING CHANNELS

CROSS-REFERENCE TO RELATED APPLICATIONS

None.

GOVERNMENT LICENSE RIGHTS

None.

BACKGROUND OF THE INVENTION

1. Field of the Invention

The present invention relates generally to a gas turbine engine, and more specifically to an air cooled turbine blade with near wall cooling.

2. Description of the Related Art Including Information Disclosed Under 37 CFR 1.97 and 1.98

In a gas turbine engine, such as a large frame heavy-duty industrial gas turbine (IGT) engine, a hot gas stream generated in a combustor is passed through a turbine to produce mechanical work. The turbine includes one or more rows or stages of stator vanes and rotor blades that react with the hot gas stream in a progressively decreasing temperature. The efficiency of the turbine—and therefore the engine—can be increased by passing a higher temperature gas stream into the turbine. However, the turbine inlet temperature is limited to the material properties of the turbine, especially the first stage vanes and blades, and an amount of cooling capability for these first stage airfoils.

The first stage rotor blade and stator vanes are exposed to the highest gas stream temperatures, with the temperature gradually decreasing as the gas stream passes through the turbine stages. The first and second stage airfoils (blades and vanes) must be cooled by passing cooling air through internal cooling passages and discharging the cooling air through film cooling holes to provide a blanket layer of cooling air to protect the hot metal surface from the hot gas stream.

FIG. 1 shows a turbine rotor blade of the prior art with near wall cooling (U.S. Pat. No. 5,702,232 issued to Moore on Dec. 30, 1997). The Moore blade includes radial flow channels formed within the airfoil walls to produce near wall cooling. Cooling air from an internal supply cavity is passed through resupply holes and into the radial near wall cooling passages and is then discharged through film cooling holes onto the external airfoil wall surfaces. Cooling air form the supply cavity also flows through a row of metering and impingement holes to produce impingement cooling for the leading edge region and through multiple impingement cooling and diffusion cavities located in the trailing edge region for the cooling of the trailing edge of the blade.

A result of the cooling design of the Moore patent above, the spanwise and chordwise cooling flow control due to airfoil external hot gas temperature and pressure variations is difficult to achieve. Also, the single radial flow channel is not the best method of utilizing the cooling air and results in a low convection cooling effectiveness. And, the dimensions for the airfoil external wall have to fulfill the casting requirements. The cooling circuit for the Moore patent is formed from an investment casting process that uses a ceramic core to form the internal cooling air features. The size and shape of these cooling air features are limited due to the constraints of the ceramic corer and the liquid metal flowing through the die. An increase in the conduction flow channels will result in a reduction of the thermal efficiency for the blade mid-chord section cooling.

BRIEF SUMMARY OF THE INVENTION

A turbine rotor blade with two counter flowing near wall cooling channels to provide cooling to an external surface of the blade yet heat up the inner wall of the blade to reduce a thermal gradient within the blade. A spanwise flowing near wall cooling channel produces near wall cooling for a thin outer wall of the blade first, and then flows into blade tip floor cooling channels to provide cooling to the tip floor. The tip floor cooling air is then discharged into a collection cavity formed by a thick inner wall of the blade. The cooling air in the collection cavity then flows through a row of impingement cooling holes to produce impingement cooling for the leading edge region.

The impingement cooling air then flows through chordwise flowing near wall cooling channels to heat up the thick inner wall. The chordwise flowing cooling air is then discharged through exit holes on the pressure side and the suction side of the blade in the trailing edge region to provide cooling for the trailing edge region.

The near wall cooling channels are formed from a metal printing process and not from an investment casting process that uses a ceramic core in order to form the outer airfoil wall thin in a range of 0.010 inches to 0.020 inches which is too thin for casting. The metal printing process can also form complex and small shapes within the cooling channels such as the arrangement of pedestals that form a criss-cross flow path along the spanwise and chordwise flowing channels that increase a conduction surface area and therefore increase a heat transfer coefficient.

DETAILED DESCRIPTION OF THE INVENTION

Figure 1:
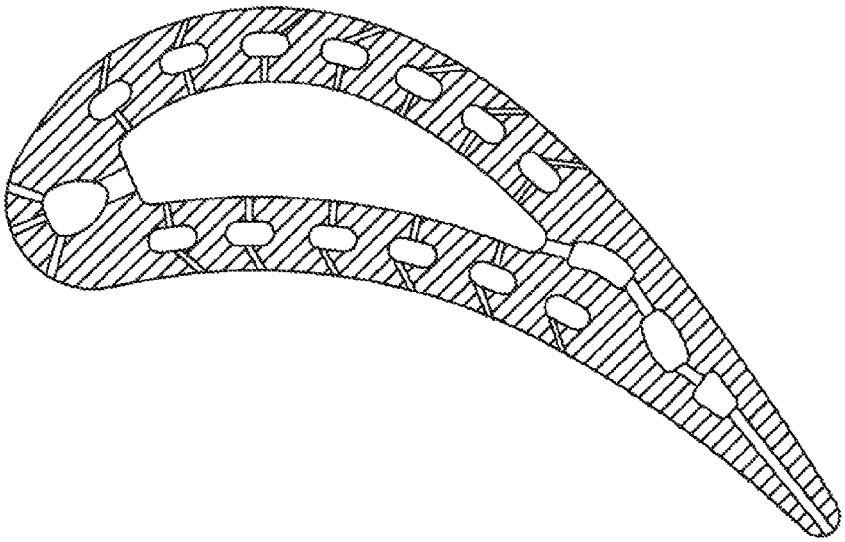
FIG 1 Prior Art
FIG. 1 shows a cross section top view of a near wall cooling circuit for a blade of the prior art.

The present invention is near wall cooling circuit for a turbine rotor blade, especially for a turbine rotor blade of an industrial gas turbine engine. The counter flowing near wall cooling channels of the present invention provides for an increase in convection cooling using less cooling air flow than the prior art FIG. 1 blade near wall cooling circuit. The counter flowing near wall cooling channels of the present invention includes such small size and small features that the investment casting process with a ceramic core cannot be sued to form the blade. A metal printing process is used to form the blade with the internal cooling air features formed by the printing process. A metal printing process such as a laser sintering process developed by Mikro Systems, Inc., of Charlottesville, Va. can be sued to form the blade with very small features.

Figure 2:
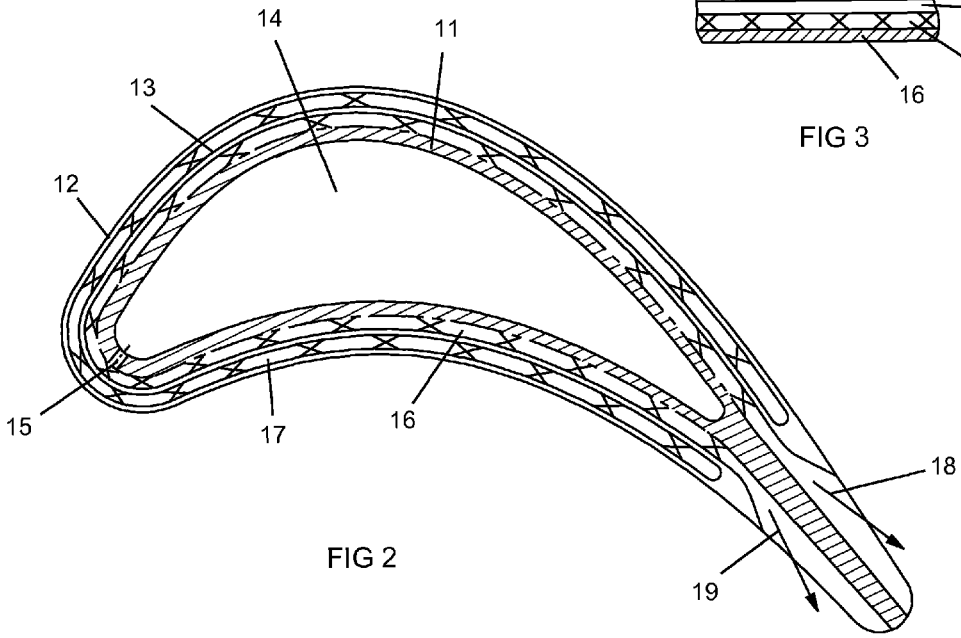
FIG. 2 shows a cross section top view of the near wall cooling channels of the blade for the present invention.

FIG. 2 shows a cross section of the blade with the counter flowing near wall cooling channels of the present invention. The blade includes a relatively thick inner wall 11 and a relatively thin outer wall 12 with a middle wall 13 in-between. An outer near wall cooling channel 17 is formed between the thin external wall 12 and the middle wall 13. An inner near wall cooling channel 16 is formed between the thick internal wall 11 and the middle wall 13. A cooling air collector cavity 14 is formed within the thick inner wall 11 and is connected to the inner near wall cooling channels by a row of leading edge impingement cooling holes 15. The outer near wall cooling channels 17 on the suction side wall are connected to exit holes 18 on in the trailing edge region and the outer near wall cooling channels 17 on the pressure side wall are connected to exit holes 19 on the pressure side of the trailing edge region.

Figure 3:
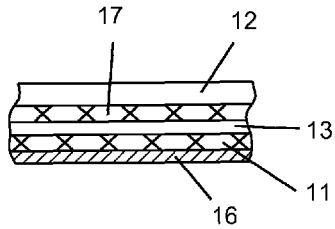
FIG. 3 shows a detailed cross section view of a section of the suction side wall of FIG. 2.
Figure 4:
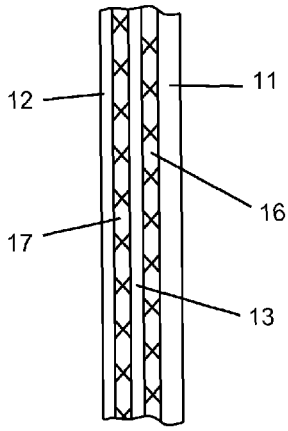
FIG. 4 shows a cross section view along a side of the near wall cooling channels of the present invention.

FIG. 3 shows a detailed view of a section of the suction side wall of the blade with the external wall 12 and the inner wall 11 with the inner near wall cooling channel 16 and the outer near wall cooling channel 17 sandwiched between the walls 11 and 12 and separated by the middle wall 13. FIG. 4 shows a detailed view of the near wall cooling channels 16 and 17 from a different view.

Figure 5:
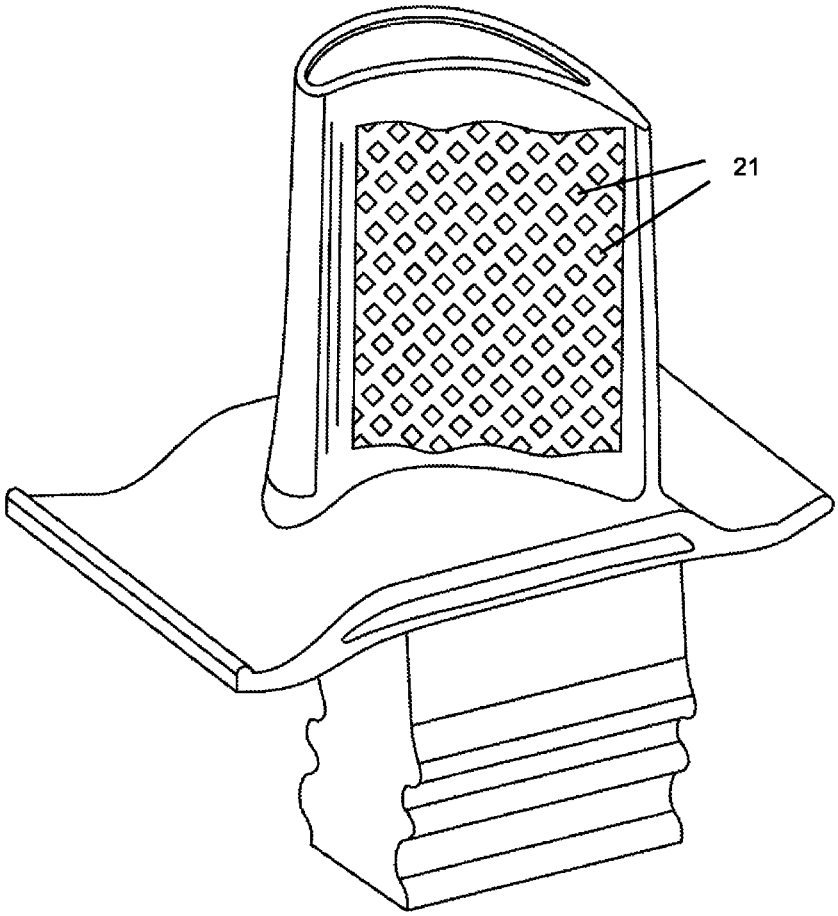
FIG. 5 shows a profile view of the blade of the present invention with a criss-cross flow path in the near wall cooling channels of the present invention.

The inner and outer near wall cooling channels 16 and 17 are formed by an arrangement of square shaped pedestals that extend across the channel and form an array of criss-cross flow paths in-between the pedestals as seen in FIG. 5. In this particular embodiment, the pedestals are arranged to form flow passages that are at 90 degrees. The pedestals provide a rigid support for the blade walls and also heat transfer fins for the channels. The pedestals thus create a high degree of turbulent flow and thus create a high heat transfer coefficient.

Figure 6:
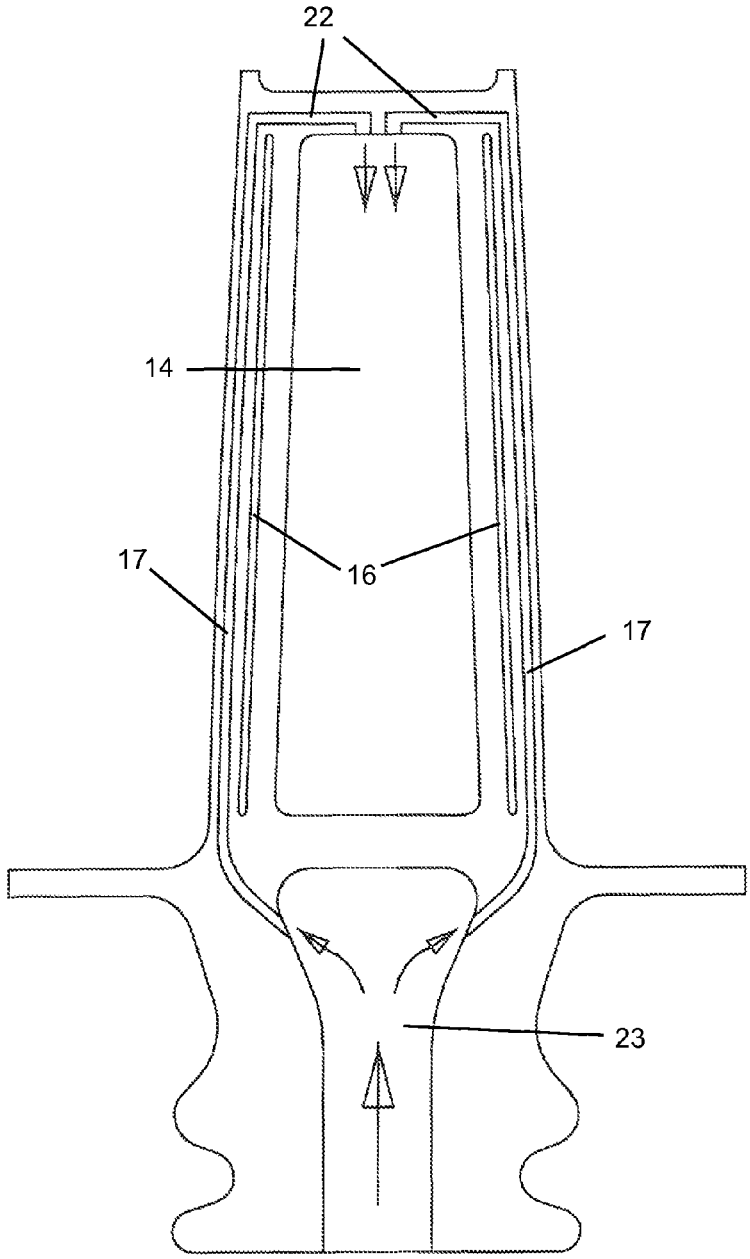
FIG. 6 shows a cross section side view of the near wall cooling channels in the blade of the present invention.

Cooling air form the counter flowing near wall cooling channels is supplied through a cooling air supply cavity 23 formed in the blade root as seen in FIG. 6 and flows into the outer near wall cooling channels 17 toward the blade tip to provide near wall cooling for the hot external thin wall 12 of the blade first. The cooling air in the outer near wall cooling channels flows upward in the blade spanwise direction in-between the square shaped pedestals and then turns and flows into tip floor cooling channels 22 to provide cooling for the squealer tip of the blade. The cooling air from the outer near wall channels 17 then flows into the cooling air collector cavity 14.

Figure 9:
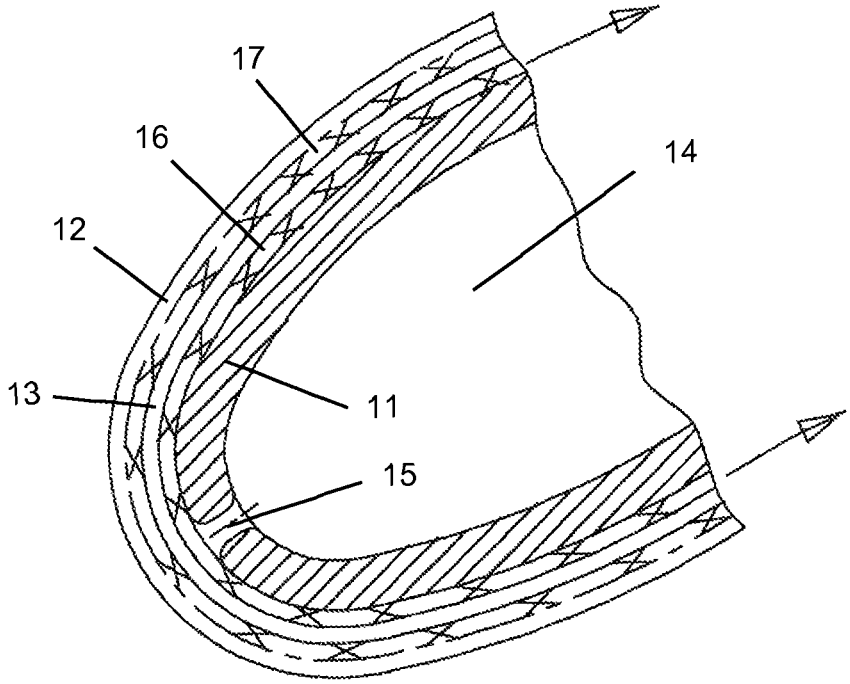
FIG. 9 shows a cross section detailed view of the leading edge region of the blade of the present invention with the near wall cooling channels.
Figure 10:
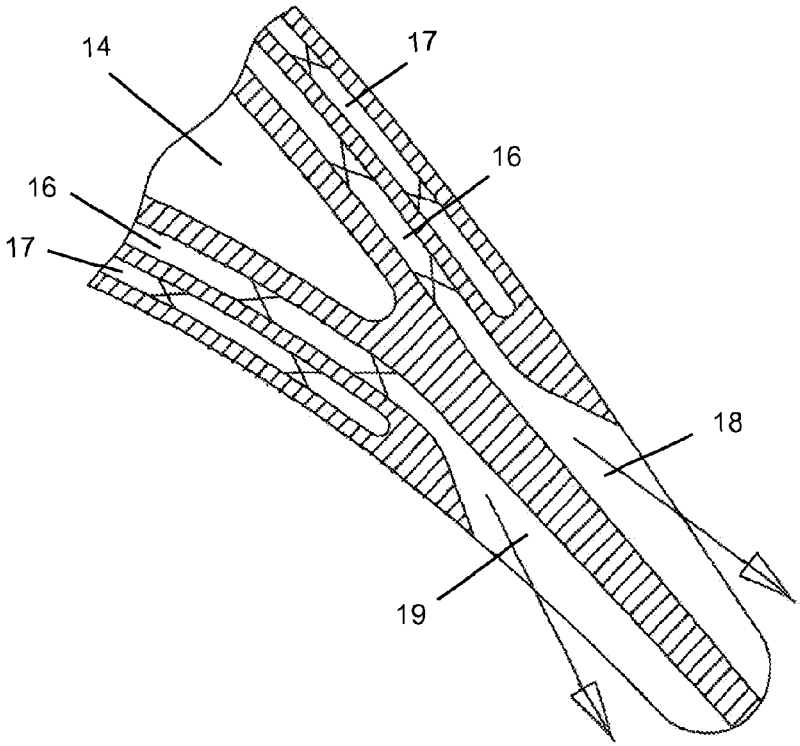
FIG. 10 shows a cross section detailed view of the trailing edge region of the blade of the present invention with the near wall cooling channels.

The cooling air in the collector cavity 14 then flows through the row of impingement cooling holes 15 in the leading edge region to produce impingement cooling on the backside surface of the leading edge of the middle airfoil wall 13. The impingement cooling air then flows into the inner near wall cooling channels 16 in the chordwise direction of the blade from the leading edge region toward the trailing edge region, passing through the pedestals in a criss-cross flow path. The cooling air from the inner near wall cooling channels 16 is then discharged out through the exit holes 18 and 19 formed on the suction side and pressure side of the trailing edge region of the blade. FIGS. 9 and 10 show an embodiment of this.

The counter flowing near wall cooling channels of the present invention provides a series of near wall cooling for the blade with a first near wall cooling flow flowing through the outer near wall cooling channel in the spanwise direction and the second near wall cooling channel flowing through the inner near wall cooling channel in the chordwise direction of the blade. The blade tip floor is cooled with the cooling air that flows from the outer near wall channels into the inner near wall channels.

In order to form the complex criss-cross flow paths in the outer and inner near wall cooling channels, an investment casting process with a ceramic core cannot be used. To form these complex features and flows passages, the metal printing process is used in which the blade and the cooling passages are formed during the printing process. The blade is built up from one end to the other with the cooling air features formed during the printing process.

Figure 7:
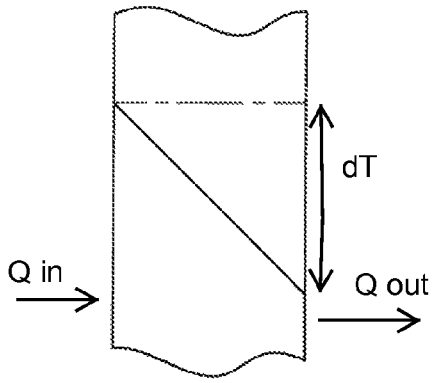
FIG. 7 shows a graphical representation of a thermal temperature gradient in an airfoil wall without cooling.
Figure 8:
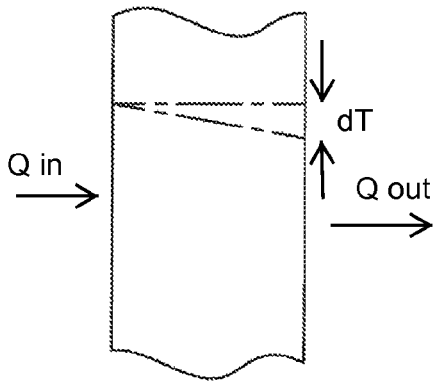
FIG. 8 shows a graphical representation of a thermal temperature gradient in an airfoil wall with cooling.

The pedestals that extend across the walls forming the near wall cooling channels are formed as squares, but could take up different shapes and sizes. The smaller the size the larger is the convection cooling surface. Higher convection surface areas will produce a higher level of convection cooling effectiveness. The inner near wall cooling channel will heat up the inner wall of the blade and therefore reduce the thermal gradient temperature appearing over the entire blade. FIGS. 7 and 8 show an embodiment of this. Because of the metal print process used to form the blade, the external wall of the blade can have a thickness in the range of 0.010 to 0.020 inches while the inner wall thickness can be around two times the thickness or 0.020 to 0.040 inches. These thicknesses are very difficult to form using the investment casting process with a ceramic core. The defective parts rate would be prohibitively too high to be even close to useful.

Each individual pedestal can be designed based on the airfoil local external heat load in order to achieve a desired local metal temperature. Thus, a maximum usage of the cooling air for a given inlet gas temperature and pressure profile in achieved. Also, the multiple layers of cooling air in the spanwise and chordwise channels yields a higher internal convection cooling effectiveness and a lower through wall thermal gradient than the single pass radial flow cooling channels used in the FIG. 1 prior art blade design.

I claim the following:

1. An air cooled turbine rotor blade comprising:

an inner wall forming a cooling air collection cavity;

an outer wall forming an airfoil surface;

a middle wall forming an outer near wall cooling channel and an inner near wall cooling channel;

a plurality of pedestals extending in the outer near wall cooling channel and the inner near wall cooling channel to form a criss-cross flow path;

a cooling air supply cavity formed in a blade root and connected to the outer near wall cooling channel;

a blade tip floor cooling channel to connected the outer near wall cooling channel to the cooling air collection cavity; and, a row of exit holes on a pressure side and a suction side connected to the inner near wall cooling channel to discharge cooling air from the blade.

2. The air cooled turbine rotor blade of claim 1, and further comprising:

the outer near wall cooling channel is a spanwise direction flowing near wall cooling channel; and, the inner near wall cooling channel is a chordwise direction flowing near wall cooling channel.

3. The air cooled turbine rotor blade of claim 1, and further comprising:

the outer and inner near wall cooling channels are connected in a series flow through the blade.

4. The air cooled turbine rotor blade of claim 1, and further comprising:

a thickness of the outer wall is in a range from 0.010 inches to 0.020 inches.

5. The air cooled turbine rotor blade of claim 1, and further comprising:

a row of impingement cooling holes connecting the cooling air collection cavity to the inner near wall cooling channel to produce impingement cooling for the leading edge of the blade.

6. The air cooled turbine rotor blade of claim 1, and further comprising:

the pedestals are square shaped pedestals and form 90 degree flow paths within the channel.

7. The air cooled turbine rotor blade of claim 4, and further comprising:

the inner wall is twice a thickness of the outer wall.

8. A process for near wall cooling of a turbine rotor blade, comprising the steps of:

supplying cooling air to a root section of the blade;

passing cooling air in a spanwise direction of the blade to produce near wall cooling of outer surfaces of the blade on the pressure side wall and the suction side wall;

passing the cooling air from the outer surfaces of the blade along a blade tip floor to cool the blade tip floor of the blade;

discharging the cooling air from the blade tip floor into a collection cavity formed within an inner wall of the blade;

impinging the cooling air from the collection cavity against a backside surface of the leading edge of the airfoil to produce impingement cooling;

passing the impingement cooling air along an inner channel of the blade in a chordwise direction to heat up the inner wall of the blade; and, discharging the chordwise flowing cooling air out from the blade on the pressure side and the suction side in the trailing edge region of the blade.

9. The process for near wall cooling of a turbine rotor blade of claim 8, and further comprising the steps of:

producing a turbulent flow of the cooling air within the spanwise cooling air flow; and, producing a turbulent flow of the cooling air within the chordwise cooling air flow.

* * * * *